United States Patent [19]

Joco

[11] Patent Number: 4,944,660

[45] Date of Patent: Jul. 31, 1990

[54] EMBEDDED NUT COMPRESSOR WHEEL

[75] Inventor: Fidel M. Joco, Long Beach, Calif.

[73] Assignee: Allied-Signal Inc., Morristown, N.J.

[21] Appl. No.: 96,566

[22] Filed: Sep. 14, 1987

[51] Int. Cl.[5] ..... F04B 17/00

[52] U.S. Cl. ..... 417/407; 416/204 A; 416/244 A

[58] Field of Search ..... 417/407, 406, 409; 416/204 A, 209, 220 R, 224, 241 B, 244 A

[56] References Cited

U.S. PATENT DOCUMENTS

| | | | |
|---|---|---|---|
| 1,665,458 | 4/1978 | Hollander | 416/244 A |
| 2,967,486 | 1/1961 | Spence | 416/244 A |
| 3,914,067 | 10/1975 | Leto | 416/244 A |
| 4,125,344 | 11/1978 | Tiefenbacher | 416/241 B |
| 4,340,317 | 7/1982 | Heitmann | 417/407 |
| 4,538,969 | 9/1985 | Ammann et al. | 417/407 |
| 4,872,817 | 10/1989 | De Kruif | 417/407 |

FOREIGN PATENT DOCUMENTS

| | | | |
|---|---|---|---|
| 673535 | 7/1979 | U.S.S.R. | 416/245 A |
| 374300 | 6/1932 | United Kingdom | 416/244 A |
| 513849 | 10/1939 | United Kingdom | 417/407 |

*Primary Examiner*—Louis J. Casaregola
*Assistant Examiner*—Timothy S. Thorpe
*Attorney, Agent, or Firm*—Ken C. Decker

[57] ABSTRACT

An improved boreless compressor wheel and method for making same by utilizing an internally threaded nut member. The compressor wheel is either cast about the nut, or includes a cup friction welded to the compressor wheel, and carrying the nut member.

16 Claims, 2 Drawing Sheets

EMBEDDED NUT COMPRESSOR WHEEL

BACKGROUND OF THE INVENTION

This invention relates generally to centrifugal compressor wheels or impellers and, to method for making same. These wheels are commonly used in turbochargers, superchargers, and the like. More specifically, this invention relates to an improved compressor wheel utilizing a hardened, internally threaded nut made of comparatively stronger material and located within the wheel itself.

So called boreless compressor wheels, such as the ones which are the subject of copending U.S. Pat. No. 4,705,463 entitled "Compressor Wheel Assembly for Turbochargers" and naming Fidel M. Joco as inventor, are able to rotate at higher speeds than compressor wheels having a through bore since more of the wheel material exists at the geometric center of the wheel. That is, more wheel material exists at the point of maximum centrifugal load. It is recognized that the portion of the compressor wheel at the axis of rotation and axially aligned with the radially outermost portion of the wheel experiences the maximum centrifugal load.

It is also recognized that the portion of the compressor wheel which aligns with the radially outermost portion of the wheel needs to be solid and free of stress raisers such as through bores in order to hold the wheel together, and yet provision must be made to attach to a shaft. Thus, a design conflict is faced by designers of compressor wheels. In conventional compressor wheels the existence of a through bore in the central hub section, from which the blades extend and exert their centrifugal force, weakens the wheel. Such a weakened wheel cannot be operated at as high a rotational speed as a wheel which does not have a bore.

In recent years, improvements in compressor technology and design have resulted in progressive increases in compression efficiencies and flow ranges, together with more rapid response characteristics. Compressors wheels for turbochargers have highly complex blade surfaces that are designed for optimum efficiency at high speeds. Such blades are most advantageously and economically made by utilizing a lightweight material, such as aluminum or aluminum alloy. Aluminum and its alloys are chosen for their relatively low rotational inertia in order to achieve a further advantage of rapid acceleration during the transition from slow to fast operating speeds.

However, it is because these wheels are cast of aluminum or aluminum alloy that they are susceptible to failures in response to tensile loading when a central bore is present. But, in the absence of a complete bore through the wheel, means must nevertheless be provided for attachment of a shaft to the wheel. The placement of threads in the comparatively soft aluminum alloy material, for direct attachment to the shaft, has not proved strong enough to withstand the high torque stresses to which the soft alloy threads will be subjected during operation. One method to avoid the above problem is outlined in the aforementioned patent application: U.S. Ser. No. 873,265, wherein a relatively harder and stronger metal piece defining the threads is friction welded onto the back of a relatively softer compressor wheel. However, frictional welding of two metals of dissimilar materials creates a less than optimal bond strength. Even though the completed compressor wheel does have a blind bore defined by the welded thread-defining piece, these wheels are referred to generally as being "boreless". Although this term is strictly incorrect, it distinguishes those compressor wheels having a through bore from those wherein the more highly stressed portion of the wheel is not subject to the disadvantage of such a bore.

SUMMARY OF THE INVENTION

Accordingly, one aspect of the present invention involves casting the compressor wheel over and around a metal nut made of stronger material than the wheel. The nut is located axially away from the portion of the wheel which experiences the aforementioned maximum centrifugal load or stress. The nut, is thus "locked in" to the compressor wheel at a location away from the center of maximum loading, and will not suffer from failure of an inertia weld of dissimilar metals, since none will be present. Since the metal nut is within the compressor wheel, a good attachment can thereby be assured. The nut can then be threadably fitted onto a threaded turbocharger shaft.

An advantage of this method of construction is that the boreless compressor wheel can be made from a lightweight low inertia material, such as aluminum or aluminum alloy, yet have the connection strength provided by the nut of stronger material engaging with the shaft.

An alternative form of the invention includes a cylindrical cup fixed and non-rotatable about an internally threaded nut. The cup is made of low inertia material such as aluminum or aluminum alloy which is friction welded to the back of a truly boreless compressor wheel. Therefore, in cases where it is not possible to cast the wheel over the nut, inertia welding will still be necessary. However, because the nut cup is preferably made of the same material as the compressor wheel, the problem of welding dissimilar metals does not occur.

BRIEF DESCRIPTION OF THE DRAWINGS

Further advantages of the invention will become apparent from the following description and claims and from the accompanying drawings wherein:

DESCRIPTION OF THE PREFERRED EMBODIMENT

Figure 1:
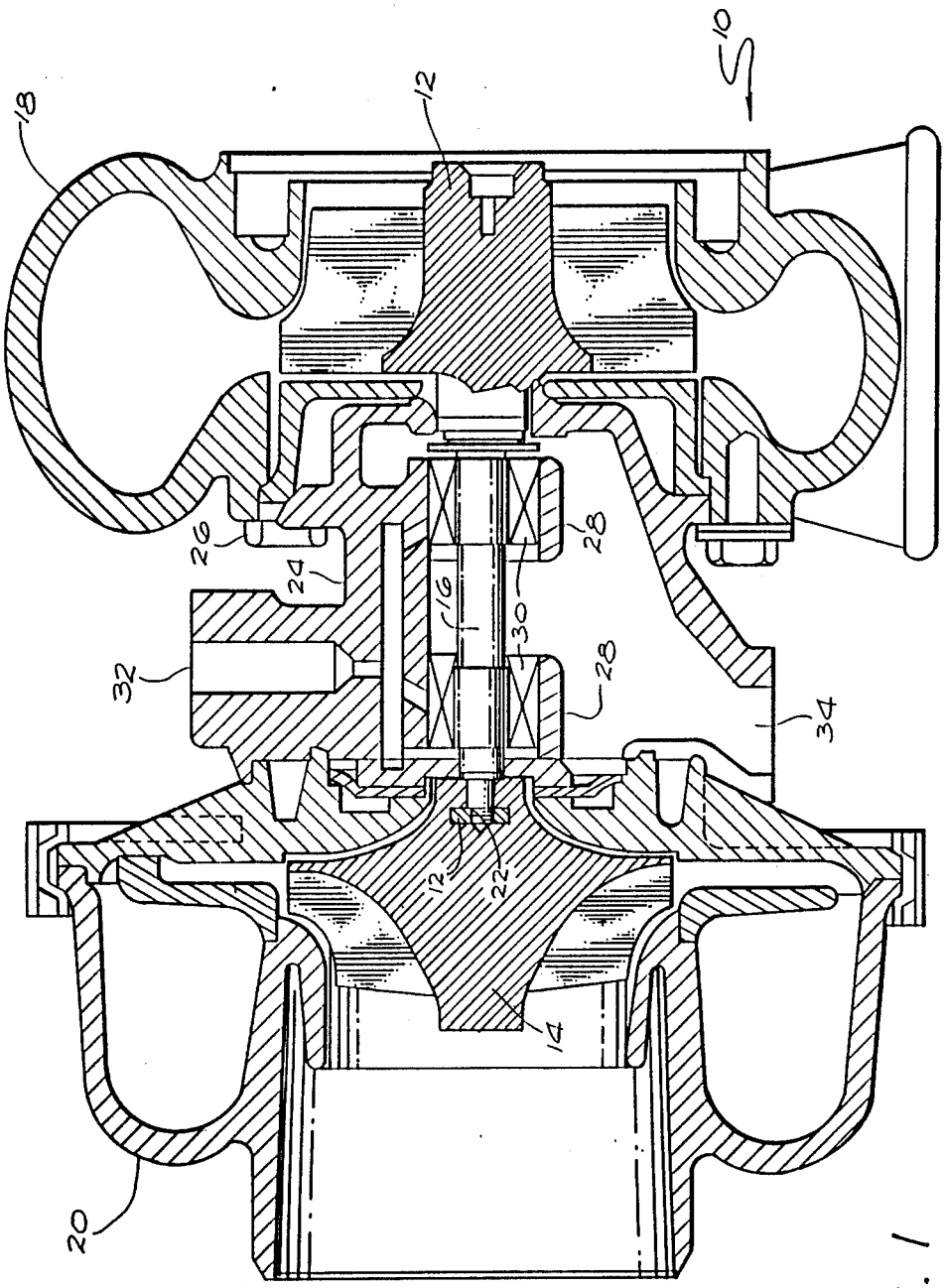
FIG. 1 is a partially cross-sectional view of an embedded nut boreless compressor wheel according to the invention.

A typical turbocharger 10 is shown in FIG. 1 and generally comprises a turbine wheel 12 and a compressor wheel 14 mounted on opposite ends of a rotatable common shaft 16. The turbine wheel 12 is disposed within the turbine housing 18 which includes an inlet for receiving exhaust gases from an engine (not shown). The turbine housing 18 guides the engine exhaust gases into communication with and expansion through the turbine wheel 12 for rotatably driving the turbine wheel. Simultaneously the turbine wheel rotatably drives the shaft 16 and compressor wheel 14, the latter of which is carried within a compressor housing 20.

Compressor wheel 10 is threadably attached onto externally disposed threads 22 defined at the end of shaft 16. The compressor wheel 14 and compressor housing 20 function to draw in and compress ambient air for supply to the intake of the engine.

The turbine housing 18 and the compressor housing 20 are mounted upon an intermediate center housing 24 as by bolts 26 or the like. Center housing 24 includes a pair of bearing bosses 28 for reception of suitable journal bearings 30 schematically illustrated for rotatably receiving and supporting the shaft 16. Lubricant such as engine oil or the like is supplied to center housing 24 by a lubricant inlet port 32 for subsequent distribution to the turbocharger bearings. Lubricant is collected in a suitable sump or drain 34 for passage back to the engine.

Figure 2:
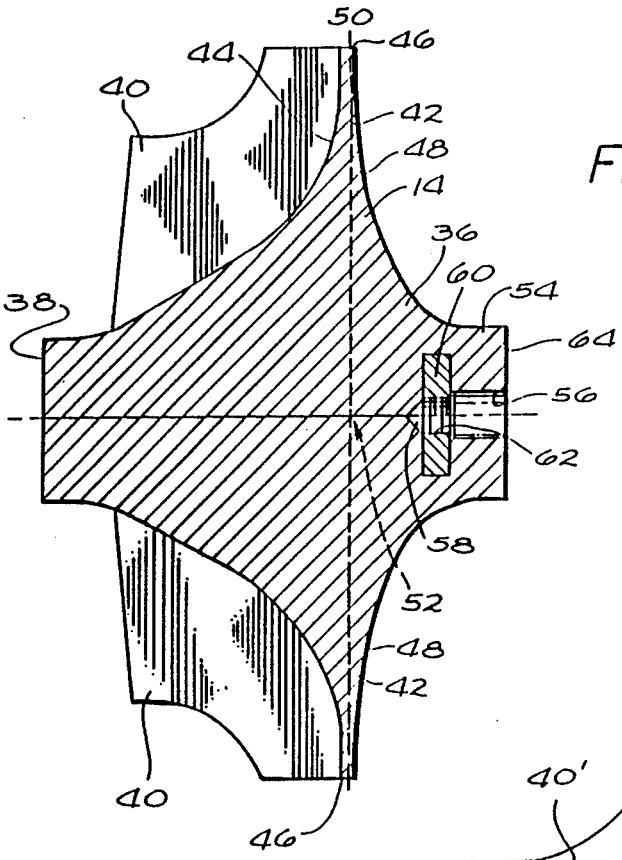
FIG. 2 provides an enlarged cross-sectional view of a compressor wheel employed in the turbocharger of FIG. 1, and illustrating one embodiment of the invention.

Referring to FIG. 2, a cross-sectional view of the preferred embodiment of the compressor wheel 14 is shown. The compressor wheel 14 includes a hub portion 36 of substantially solid metal. The hub portion 36 defines an inlet side or front face surface 38 for the compressor wheel 14, and carries a plurality of circumferentially spaced apart compressor blades 40 (only two of which are visible in FIG. 2) extending both radially outwardly and axially thereon. The hub portion 36 also includes a radially enlarged disc-like portion 42 which serves to support the compressor blades 40 as well as to define a floor surface 44 for the air flow channels defined between blades 40. The disc-like portion 42 also defines a radially outer circumferential surface 46 for hub 36, as well as an axially disposed back side or back face surface 48 therefor.

As will be recognized by those skilled in the pertinent art, in operation of compressor wheel 14, a plane of maximum stress 50 exists substantially in axial alignment with the maximum radial extent of the hub 36. That is, the plane of maximum stress 50 is expected to be coincident with surface 46. At any selected radial location within compressor wheel 14, the maximum tensile stress will be experienced at plane 50, and will increase radially inwardly. Thus, the maximum stress within wheel 14 is experienced at the point where the rotational axis transects plane 50, approximately at point 52.

In order to avoid the undesirable stress concentration of a conventional through bore and preserve the strength of solid metal adjacent to point 52, the present inventive compressor wheel includes a boss portion 54 integrally defined by hub 36 and extending axially away from the plane 50. Boss portion 54 defines an axially extending central blind bore 56. The bore 56 extends toward plane 50, but stops well short thereof to terminate at an end surface 58. Circumscribing and defining a portion of the bore 56 adjacent end surface 58 is a nut member 60 formed of metal which is comparatively stronger than the remainder of compressor wheel 14. The nut member 60 defines female threads 62 along a portion of bore 56, and which are threadably engageable by a shaft 16 extending into bore 56 (recalling FIG. 1). The nut member 60 is non-rotatably embedded within compressor wheel 14 so that the latter may be threaded onto the shaft 16 to engage an abutment surface 64 of the boss 54 with a shoulder of shaft 16. The threads 62 of nut 60 may have either a right or left hand direction dependent upon the direction of rotational shaft 16 in driving compressor wheel 14. The direction of threads 62 is chosen so that prevaling torque from shaft 16 tightens the nut member 60 and compressor wheel 14 upon shaft 16 and against the shoulder thereof at abutment surface 64.

Having observed the structure of compressor wheel 14, attention may now be directed to the method of making such a structure. By way of example, the compressor wheel 14 may be made by investment casting. In this case, the configuration of the compressor wheel 14 is defined by a cavity within a frangible ceramic mold (not shown). However, it is easily understood that the nut member 60 will in this case be supported within the cavity of the mold in the position it is to occupy in the cast wheel 14 by an elongate support member extending generally along the axis of bore 56. Such a support member is necessary to space the nut member 60 above the surface 64 and within the mold cavity which will be filled by molten metal defining the remainder of compressor wheel 14 when solidified. A convenient way to provide such a support member is to define a shallow recess in the mold cavity aligning with the rotational axis of the compressor wheel to be cast therein, and to dispose a replica of the end of shaft 16 carrying nut member 60 in the recess so provided. This support member shaft will necessarily define a portion extending through the nut member 60 to define surface 58 of bore 56. Also, by selecting the diameter of the support member defining bore 56 intermediate of nut member 60 and surface 64 so as to allow for thermal shrinkage of the casting metal, the bore 56, it is believed, may be used as cast without need for subsequent finish boring.

Figure 3:
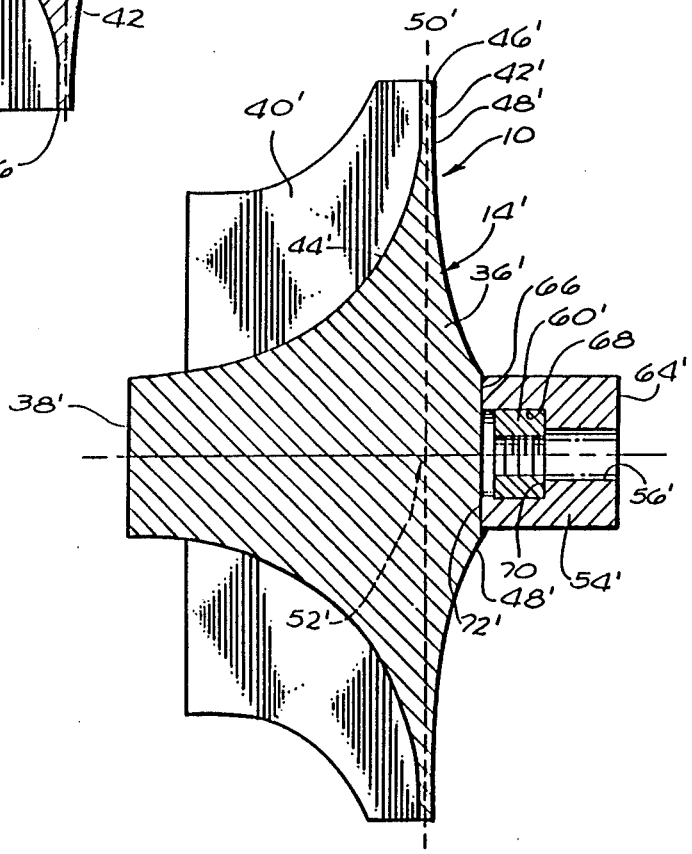
FIG. 3 provides a cross-sectional view of a compressor wheel according to an alternative embodiment of the invention.

Referring to FIG. 3, an alternative embodiment of the invention is depicted. In order to provide continuity of description, features of FIG. 3 which are analogous in structure or function to those of FIG. 2 are referenced with the same numeral used above, and having a prime added thereto.

A compressor wheel 14' includes a hub portion 36' with front face 38', blades 40', a disc portion 42' defining a floor surface 44' and back surface 48' as well as a radially outer circumferential surface 46'. A plane 50' of maximum stress is coincident with surface 46' and where transected by the rotational axis of the wheel 14' defines a point 52' of maximum centrifugally induced stress. Compressor wheel 14' also includes a boss portion 54' extending axially from the back surface 48', and defining a stepped blind bore 56' receiving a nut member 60' of relatively stronger material.

However, in contrast with the embodiment of FIG. 1, compressor wheel 14' of FIG. 2 includes a hub portion 36' and boss 54' which are not cast integrally together. Instead, the hub portion 36' including blades 40' and disc portion 42' is cast as a truly boreless compressor wheel which is free of a central through bore, but which is also without any means or feature for attachment thereof to a drive shaft. The hub portion 36' does define a central planar bonding surface 66. Weldingly secured to the hub portion 36' at surface 66 is a tubular nut cup member 54' which defines the above-described boss portion 54' of the completed compressor wheel 14'.

Viewing FIG. 3, it is easily seen that prior to its welding to the hub 36', the nut cup member 54' is of tubular configuration defining a stepped through bore 56 having a larger diameter portion 68 cooperating with the remainder of the bore to define a shoulder 70. The bore 56' opens at one end of nut cup member 54' in abutment surface 64' and opens on the other end of the nut cup in a bonding or welding surface 72.

Prior to welding of nut cup member 54' to hub 36', the nut member 60' is inserted into bore portion 68 to seat against shoulder 70. The nut member 60' may be interference fitted into bore portion 68, or may define splines or other means thereon to non-rotatably engage the nut cup member 54'. Alternatively, the nut cup member 54' may be cast around the nut member 60' after which finish machining operations are employed to precisely define abutment surface and welding surface 64' and 72, respectively.

After forming the nut cup member 54' and providing nut member 60' therein, the nut cup member 54' is inertia welded at its surface 72 to bonding surface 66 of hub portion 36 so as to define the completed boss portion 54' of compressor wheel 14. Preferably, the portion 54' is made of the same metal as hub 36', or of a metal compatible therewith. As a result, the problem of inertia welding dissimilar metals is avoided by the present invention.

While two particularly preferred embodiments of the present invention have been depicted, described, and defined above, such reference to preferred embodiments of the invention does not imply a limitation upon the invention and no such limitation is to be inferred. The invention is intended to be limited only in accord with the spirit and scope of the appended claims, which also provide additional definition of the invention.

Having described the invention with sufficient clarity that those skilled in the art may make and use it: What is claimed is:

1. A compressor wheel for rotation about an axis of rotation including a hub defining said axis of rotation, said hub including a pair of ends, a radially projecting portion between said ends, said radially projecting portion defining a transverse plane between said ends, and a pair of radially tapering surfaces extending between said radially projecting portion toward a corresponding ones of said ends, aerodynamic blade means carried on the surface extending between said radially projecting portion and one end of the hub, the other surface terminating in a boss portion extending to the other end of said hub, said boss defining a blind bore therein extending from said other end of the hub toward said transverse plane defined by the radially projecting portion but terminating in an end surface located between said other end of the hub and said transverse plane, and a retaining member carried in said boss portion between said other end of the hub and the end surface of the blind bore for engagement with a supporting shaft, said retaining member defining an aperture coaxial with said blind bore for engagement by said shaft.

2. A compressor wheel as claimed in claim 1, wherein said retaining member is made from a material different from the material from which the hub is made.

3. A compressor wheel as claimed in claim 2, wherein the material from which the hub and blades are make has a weight per unit volume less than the weight per unit volume from which the retaining member is made.

4. Compressor wheel as claimed in claim 3, wherein said hub and blades are made from a material selected from the group consisting of aluminum and aluminum alloys.

5. Compressor wheel as claimed in claim 2, wherein said retaining member is a nut.

6. Compressor wheel as claimed in claim 5, wherein said aperture is defined by said nut, said aperture being threaded to engage corresponding threads on said shaft.

7. Compressor wheel as claimed in claim 6, wherein said shaft defines a shoulder for engagement with an abutment surface on said other end of the hub, the threads on said shaft and the aperture of the nut being in a direction wherein the prevailing torque exerted on said compressor wheel by said shaft tightens said shoulder into engagement with said abutment surface.

8. Compressor wheel as claimed in claim 7, wherein said boss portion is a separate member secured to said hub.

9. A turbocharger comprising a housing, a shaft rotatable in said housing having a pair of opposite ends, a compressor wheel mounted on one end of the shaft for rotation therewith, a turbine wheel mounted on the other end of the shaft for rotating the latter, said housing including exhaust gas inlet and outlet means for communicating gasses to and from said turbine wheel and air inlet and outlet means of communicating air to and from said compressor wheel, said compressor wheel including a hub defining said axis of rotation, said hub including a pair of ends, a radially projecting portion between said ends, said radially projecting portion defining a transverse plane between said ends, and a pair of radially tapering surfaces extending between said radially projecting portion toward a corresponding ones of said ends, aerodynamic blade means carried on the surface extending between said radially projecting portion and one end of the hub, the other surface terminating in a boss portion extending to the other end of said hub, said boss defining a blind bore therein extending from said other end of the hub toward said transverse plane defined by the radially projecting portion but terminating in an end surface located between said other end of the hub and said transverse plane, and a retaining member carried in said boss portion between said other end of the hub and the end surface of the blind bore for engagement with said shaft, said retaining member defining an aperture coaxial with said blind bore for engagement by said shaft.

10. A compressor wheel as claimed in claim 9, wherein said retaining member is made from a material different from the material from which the hub is made.

11. A compressor wheel as claimed in claim 10, wherein the material from which the hub and blades are make has a weight per unit volume less than the weight per unit volume from which the retaining member is made.

12. Compressor wheel as claimed in claim 11, wherein said hub and blades are made from a material selected from the group consisting of aluminum and aluminum alloys.

13. Compressor wheel as claimed in claim 10, wherein said retaining member is a nut.

14. Compressor wheel as claimed in claim 13, wherein said aperture is defined by said nut, said aperture being threaded to engage corresponding threads on said shaft.

15. Compressor wheel as claimed in claim 14, wherein said shaft defines a shoulder for engagement with an abutment surface on said other end of the hub, the threads on said shaft and the aperture of the nut being in a direction wherein the prevailing torque exerted on said compressor wheel by said shaft tightens said shoulder into engagement with said abutment surface.

16. Compressor wheel as claimed in claim 15, wherein said boss portion is a separate member secured to said hub.

* * * * *